US008689403B2

(12) United States Patent
Löwen

(10) Patent No.: US 8,689,403 B2
(45) Date of Patent: Apr. 8, 2014

(54) DOOR HINGE FOR MOTOR VEHICLES

(75) Inventor: Jakob Löwen, Gummersbach (DE)

(73) Assignee: Metalsa Automotive GmbH, Bergneustadt (DE)

( * ) Notice: Subject to any disclaimer, the term of this patent is extended or adjusted under 35 U.S.C. 154(b) by 18 days.

(21) Appl. No.: 13/509,810

(22) PCT Filed: Nov. 5, 2010

(86) PCT No.: PCT/EP2010/066904
§ 371 (c)(1),
(2), (4) Date: Jun. 19, 2012

(87) PCT Pub. No.: WO2011/057966
PCT Pub. Date: May 19, 2011

(65) Prior Publication Data

US 2012/0246875 A1 Oct. 4, 2012

(30) Foreign Application Priority Data

Nov. 15, 2009 (DE) ..... 10 2009 052 803

(51) Int. Cl.
*E05D 11/10* (2006.01)

(52) U.S. Cl.
USPC ..... 16/334; 16/309; 16/313

(58) Field of Classification Search
USPC ..... 16/277, 281, 286, 309, 313, 319, 335, 16/337, 342, DIG. 43, 334; 296/146.11, 296/146.12
See application file for complete search history.

(56) References Cited

U.S. PATENT DOCUMENTS

| | | | | |
|---|---|---|---|---|
| 2,240,790 | A * | 5/1941 | Kuney | 16/334 |
| 4,785,498 | A * | 11/1988 | Brotschi | 16/238 |
| 4,937,916 | A * | 7/1990 | Redman | 16/243 |
| 6,704,966 | B1 * | 3/2004 | Kao | 16/252 |
| 6,766,561 | B1 * | 7/2004 | Cheng | 16/235 |
| 7,461,432 | B2 * | 12/2008 | Lowen et al. | 16/334 |
| 7,891,054 | B2 * | 2/2011 | Nicolas Domingo | 16/334 |
| 8,108,969 | B2 * | 2/2012 | Ochiai | 16/334 |
| 2001/0022011 | A1 * | 9/2001 | Vittorio | 16/334 |
| 2003/0093873 | A1 * | 5/2003 | Linnenbrink | 16/85 |
| 2007/0050940 | A1 * | 3/2007 | Lowen et al. | 16/334 |
| 2009/0133222 | A1 * | 5/2009 | Ochiai | 16/347 |

FOREIGN PATENT DOCUMENTS

| | | |
|---|---|---|
| DE | 200 15 850 U1 | 2/2002 |
| EP | 0 816 610 A2 | 1/1998 |
| EP | 2 098 667 A1 | 9/2009 |

* cited by examiner

*Primary Examiner* — Roberta Delisle
(74) *Attorney, Agent, or Firm* — Miller Canfield Paddock and Stone

(57) ABSTRACT

A motor vehicle door hinge, having a pillar fitting able to be mounted on a vehicle body, and a door fitting able to be mounted on a motor vehicle door, which are connected to each other in an articulated manner by a hinge pin connected to either the pillar fitting or the door fitting in a rotation-resistant manner and to the remaining one of the pillar fitting or the door fitting in an articulated manner, and an arresting unit having a detent body carrier connected to the hinge pin in a rotation-resistant manner and radially extending to the latter and having a detent body, and a detent element adjustable on the other one of the pillar fitting or the door fitting with respect to the detent body carrier, coaxially arranged with respect to the hinge pin axis and in engagement with the detent body and including at least one detent notch, and arranged within a housing surrounding the hinge pin and the detent body carrier.

17 Claims, 4 Drawing Sheets

DOOR HINGE FOR MOTOR VEHICLES

FIELD OF THE INVENTION

The invention relates to a motor vehicle door hinge, comprising a pillar fitting able to be mounted on a vehicle body, and a door fitting able to be mounted on a motor vehicle door, which are connected to each other in an articulated manner by means of a hinge pin connected to either the pillar fitting or the door fitting in a rotation-resistant manner and to the remaining one of the pillar fitting or the door fitting in an articulated manner, and an arresting unit comprising a detent body carrier connected to the hinge pin in a rotation-resistant manner and radially extending to the latter and having a detent body, and a detent element adjustable on the other one of the pillar fitting or the door fitting with respect to the detent body carrier, coaxially arranged with respect to the hinge pin axis and in engagement with the detent body and including at least one detent notch, and arranged within a housing surrounding the hinge pin and the detent body carrier.

BACKGROUND OF THE INVENTION

Motor vehicle door hinges with arresters serve to mount a vehicle door on a vehicle body and various configurations are known from the state of the art, A basic problem with mounting the vehicle door on the vehicle body—if there is no continuous arresting of the position of the vehicle door—is the provision of the highest possible number of detent positions by the arrester so that the door is secured against inadvertent pivoting with respect to the vehicle body in as many opening positions as possible.

A generic motor vehicle door hinge of the initially mentioned type is known, for example, from DE 200 15 850 U1. The arrester of this motor vehicle door hinge has a housing connected to a hinge part, in which a detent body carrier is pivotable with respect to a detent element provided with detent notches. Arresting of the vehicle door is carried out by the detent body engaging the detent notches.

The housing of the arrester has the drawback of a cup-shaped configuration, however, into which the detent body carrier can only be placed in the housing interior from one side, which results in additional assembly overhead due to accessibility being restricted to only one side. Furthermore, the manufacture of the housing is very cumbersome and expensive because its configuration, having a housing bottom, is complex.

SUMMARY OF THE INVENTION

Based on the above, it is the object of the present invention to provide a motor vehicle door hinge of the initially mentioned type that can be manufactured in a cost-effective manner.

The invention achieves the object by a motor vehicle door hinge comprising a pillar fitting able to be mounted on a vehicle body, and a door fitting able to be mounted on a motor vehicle door, which are connected to each other in an articulated manner by means of a hinge pin connected to either the pillar fitting or the door fitting in a rotation-resistant manner and to the remaining one of the pillar fitting or the door fitting in an articulated manner, and an arresting unit comprising a detent body carrier connected to the hinge pin in a rotation-resistant manner and radially extending to the latter and having a detent body, and a detent element adjustable on the other one of the pillar fitting or the door fitting with respect to the detent body carrier, coaxially arranged with respect to the hinge pin axis and in engagement with the detent body and including at least one detent notch, and arranged within a housing surrounding the hinge pin and the detent body carrier, characterized in that the housing has a top and a bottom housing opening in opposing relationship in the hinge axis direction and closed off by correspondingly formed closure elements, wherein both housing openings are formed in such a manner that they allow the hinge pin provided with the detent body carrier access to the housing interior. Advantageous embodiments of the invention are defined in the dependent claims.

A characteristic of the motor vehicle door hinge according to the present invention is a configuration of the housing, which is manufactured of one extruded profile, with a top and bottom housing opening arranged in an opposing relationship as seen in the hinge axis direction. The housing openings are configured in such a manner that the detent body carrier can be placed in the housing interior both via the top and the bottom housing opening, wherein the detent body carrier together with the detent body supported thereon is adjustable relative to the detent element. The housing openings are closed by means of closure elements formed in correspondence to the housing openings to ensure the functionality of the arrester, namely to protect it against damaging exterior influences, wherein the housing interior extending from the top to the bottom housing opening has an inner cross-section remaining essentially uniform in the hinge axis direction.

The rotation-resistant connection of the hinge pin with either the door or the pillar fitting, the rotation-resistant connection of the detent body carrier supporting the detent body with the hinge pin and the rigid connection of the detent element with the other one of the door or the pillar fitting ensures that pivoting of the motor vehicle door leads to a relative movement of the detent body with respect to the detent element. As the motor vehicle door is pivoted, the detent body passes into the detent notches arranged on the detent element, whereby the motor vehicle door is secured against inadvertent pivoting.

Compared to the motor vehicle door hinges known from the state of the art, the configuration according to the present invention allows substantially simplified assembly of the motor vehicle door hinge, in particular of the arrester. The excellent accessibility of the arrester and the option to access the housing interior via both housing openings facilitates assembly of the motor vehicle door hinge and its maintenance and if needed, its repair even when in a mounted state on the vehicle.

Basically it can be freely chosen, also taking the structural framework conditions into account, to which of the parts of the door and pillar fitting the hinge pin is connected in a rotation-resistant manner and which is connected to the housing. According to an advantageous embodiment of the invention, however, the hinge pin is connected to the door fitting in a rotation-resistant manner, and the housing is arranged on the pillar fitting, so that a pivoting movement of the vehicle door leads to adjustment of the detent body with respect to the detent element connected to the pillar fitting. This configuration of the invention has the advantage that in case the door is dismantled by separating the motor vehicle hinge, the more voluminous pillar fitting with the housing of the arrester remains on the motor vehicle, which facilitates simpler storage of the removed vehicle door. Separation of the motor vehicle door hinge is usually carried out by releasing the releasably configured rotation-resistant connection of the hinge pin with the door fitting.

Essential for the motor vehicle door hinge according to the present invention is the possibility of arranging the detent body carrier in the housing interior via both housing openings. However, the configuration of the housing openings is basically freely selectable as long as precisely this accessibility is ensured. According to a further embodiment of the invention it is provided, however, that the top and bottom housing openings have an essentially identical opening cross-section so that both housing openings provide equivalent access to the housing interior. This further embodiment additionally allows the housing to be manufactured in a cost-effective manner since the same tools and identical manufacturing processes are applicable for the manufacture of the housing openings. Furthermore, this embodiment of the invention offers the possibility of using identical closure elements for both housing openings, which additionally helps in reducing costs and facilitates the assembly of the motor vehicle door hinge.

An additional reduction in manufacturing cost can also be achieved according to the invention by the housing interior having an essentially uniform inner cross-section extending from the top to the bottom housing opening in the hinge axis direction. This embodiment according to the invention usually allows the housing interior to be manufactured in a single manufacturing step without specialized tools due to the continuous uniform cross-sectional geometry from the top to the bottom housing opening, wherein according to the invention there are made arrangements for the use of prefabricated extruded profiles already provided with a longitudinal channel corresponding to the interior. The housing can then be formed by simply cutting to size the extruded profile that, can also be made in a cost-effective manner.

The pillar and the door fitting can basically be manufactured of a plurality of parts connected to each other, wherein the type of connection is always freely selectable. If an extruded profile is used for manufacturing the housing, it only needs to be connected to a base plate suitable for mounting on the vehicle body, wherein the connection can be of an interlocking, metallurgical and/or frictional type.

According to a further embodiment of the invention, however, the pillar fitting is integrally formed. Accordingly, the base plate and the housing adjacent to the base plate and, if present, a beam carrying the housing, are formed in one component. This further embodiment of the invention has the additional advantage of a reduced assembly overhead, since the pillar fitting need not be assembled, and in the case of the door fitting also having an integral configuration, the door fitting need not be assembled either. Moreover, the presence of tolerances resulting from assembly which can sometimes lead to malfunctions can be completely avoided with the integral configuration.

The closure elements for closing off the housing interior can basically have any configuration as long as the housing openings are reliably closed off. The closure elements can also be configured in such a manner that they fulfill further functions, such as the support of the hinge pin extending through them. Particularly advantageously, the closure elements are formed by a top and bottom housing cover for the sealing closure of the housing interior. The housing covers can be additionally formed to receive sealing elements, or they can be of the self-sealing type. In the case of an advantageously provided configuration, according to which the top and bottom housing openings have an identical opening cross-section, there is also the possibility of using just one type of housing cover that can be used to close off both housing openings. This can also help to reduce the manufacturing cost.

The detent element having at least one detent notch, in cooperation with the detent body in engagement with it, is for arresting the vehicle door in the opening position associated with the detent notch. The position of the detent body is changed due to a pivoting movement of the vehicle door relative to a detent surface of the detent element having the detent notch, with which the detent body is in engagement. The configuration of the detent element with its detent surface can be freely selected according to the structural specifications. In addition to the essentially free choice of materials which, among other things, conveniently allows the operating torques to be determined while taking the structural specifications into account, while also taking the choice of material for the detent body and the type of frictional pairing with the detent body into consideration, the arrangement of the detent element is also freely selectable. There is thus the option, among other things, to form the detent element on the inner side wall of the housing interior so that the detent element is integrally formed with the housing. The number of detent positions of the vehicle door can be determined by the number of detent notches.

According to a particularly advantageous embodiment of the invention, the detent element is arranged, however, on an inner side wall of the housing interior in an interlocking, frictional and/or metallurgical connection. This embodiment also enables the material of the detent element to be selected in a manner independent of the material choice for the housing, whereby a substantially greater range of materials can be used. In addition to an optimum configuration of the material pairing, the cost for the motor vehicle door hinge can be additionally reduced. Moreover, the use of a separate detent element offers the possibility, if needed, to exchange it for maintenance or repair purposes, wherein an interlocking connection is particularly advantageous in this case. If required, the inner surface of the interior supporting the detent element is configured in such a manner that an interlocking connection of the correspondingly shaped detent element is possible.

The type of connection between the detent body carrier and hinge pin is basically freely selectable provided that a rotation-resistant connection is established. For example, a connection of a press-fit type or a metallurgical connection are thus conceivable. According to a further embodiment of the invention, the detent body carrier has a profiled receiving opening for interlocking engagement with the hinge pin having a correspondingly shaped connection section. The receiving opening and the connection section can thus have a polygonal form, for example, or be provided with a toothed profile. This embodiment of the invention enables particularly simple assembly, and disassembly in case of repair. Also the interlocking engagement ensures high functional safety.

The configuration of the detent body and the detent notches on the detent surface as well as the number of detent bodies supported on the detent body carrier or the type of support on the detent body carrier are basically freely selectable. The detent bodies can thus be formed by spheres simultaneously or alternately coming into engagement with the associated detent notches. The detent bodies can be supported in such a manner that they cooperate with the detent element in sliding and/or rolling friction. The detent notches can have a symmetrical or asymmetrical profile in cross-section, whereby operating forces differing according to the movement direction of the vehicle door can be realized.

According to an advantageous embodiment of the invention, the detent body is, however, formed by a cylindrical pin biased toward the detent element and rotatably supported on the detent body carrier. This embodiment of the invention allows sufficiently high detent torques to be realized in a small structural space. The cylindrical pin has the additional advantage that it can be rotatably supported on the detent body carrier in a particularly simple manner, wherein the detent body is advantageously held in a correspondingly formed detent body recess on the detent body carrier.

Particularly advantageously, the detent body is biased toward the detent surface, whereby reliable contact is ensured on the detent element. The biasing force can be adjustable, in particular, whereby adjustment or readjustment to achieve the required detent torques is ensured in a simple manner. Helical pressure springs are particularly suitable for biasing, which are held on the detent body carrier in such a manner that on the one hand they contact the detent body carrier and on the other hand they bias the detent body toward the detent element. An adjustability of the spring force can be achieved by means of adjustment of the contacting surface of the helical pressure spring on the part of the detent body carrier.

As already mentioned above, the selection of the material for the pillar fitting and/or the door fitting is free. Aluminum alloys are particularly suitable, however, for manufacture so that an additional weight reduction can be achieved.

BRIEF DESCRIPTION OF THE DRAWINGS

An exemplary embodiment of the invention will be described in more detail in the following with reference to the accompanying drawings, wherein.

DETAILED DESCRIPTION OF THE INVENTION

Figure 1:
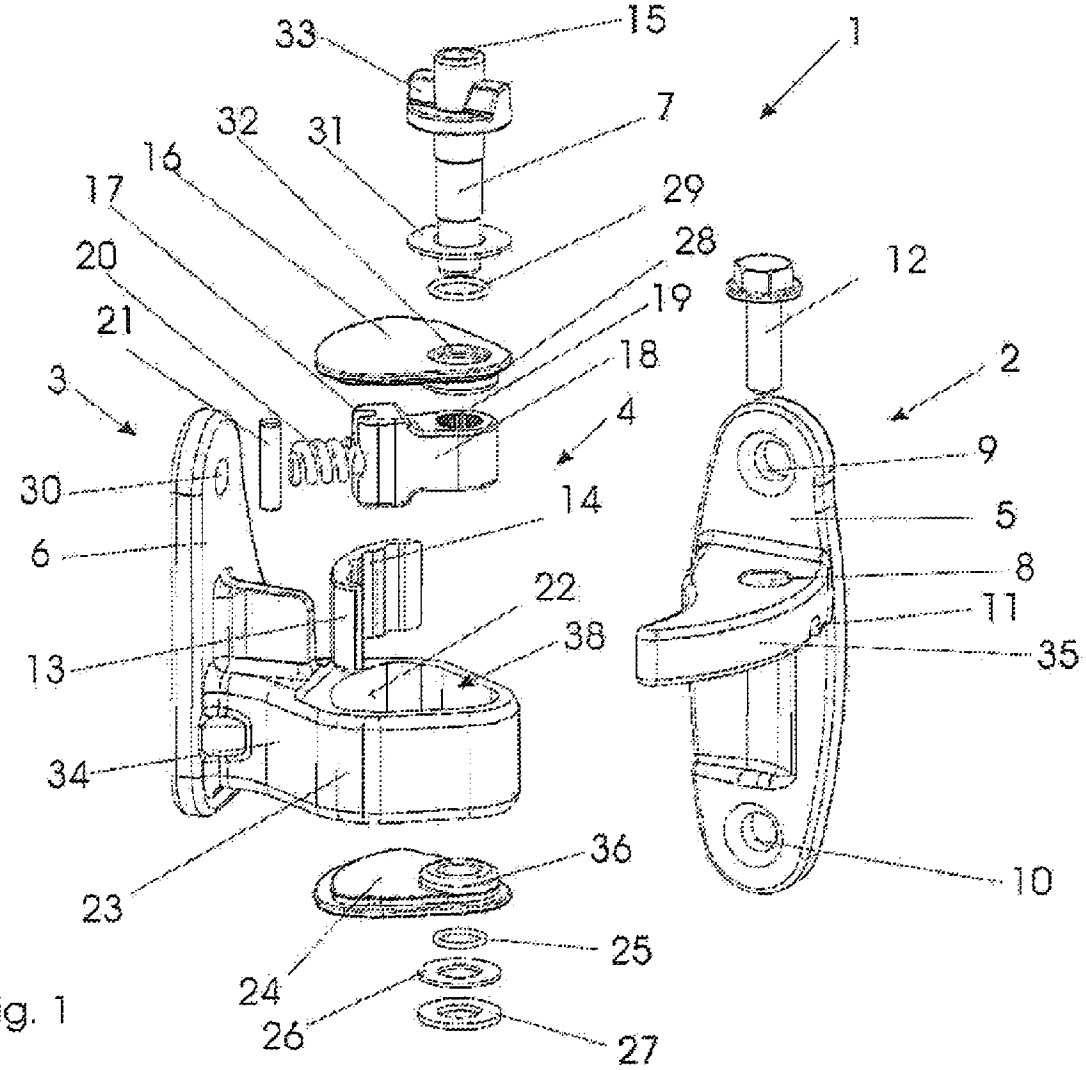
FIG. 1 is an exploded view of a motor vehicle door hinge with an arrester.
Figure 2:
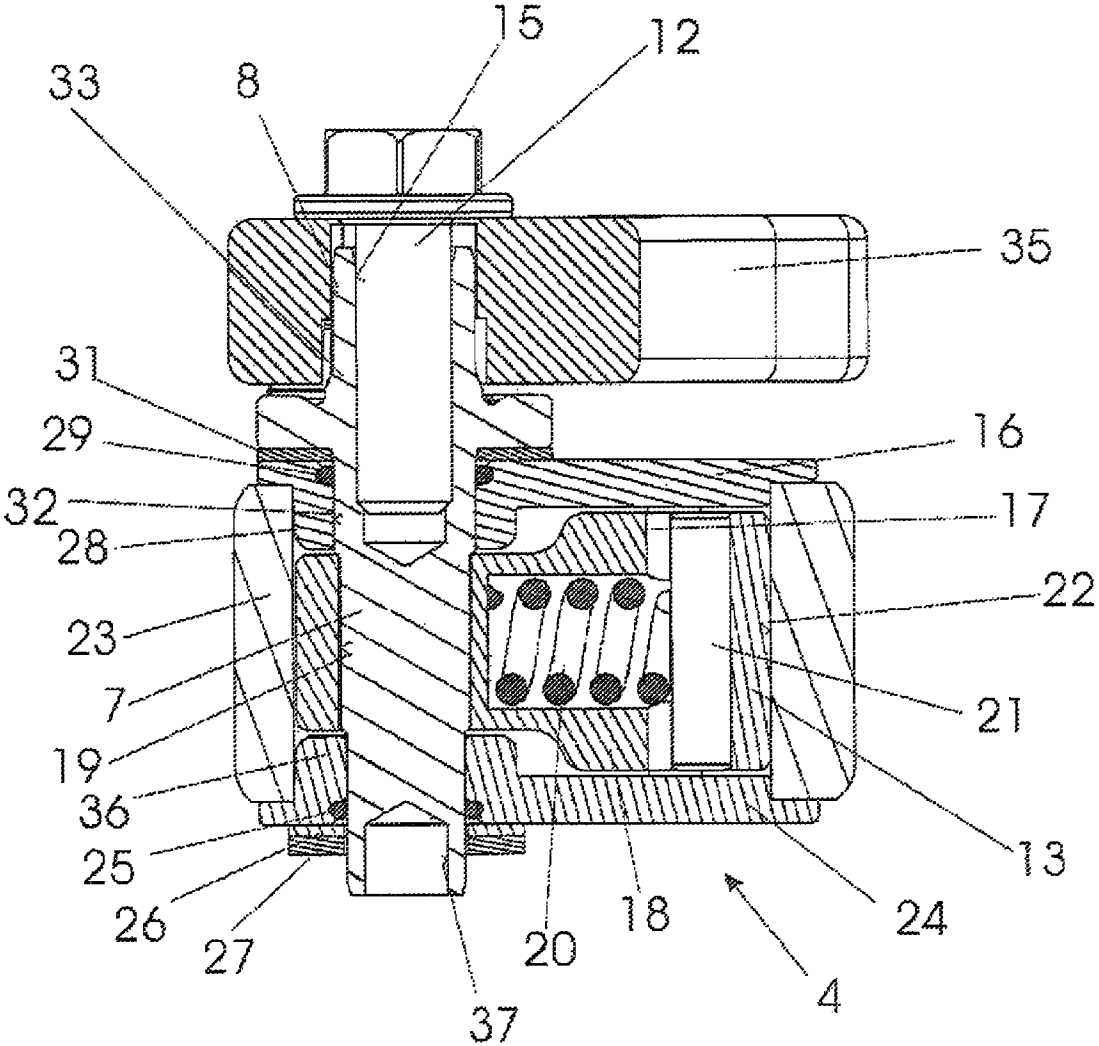
FIG. 2 is a sectional view of the arrester of FIG. 1.
Figure 3A:
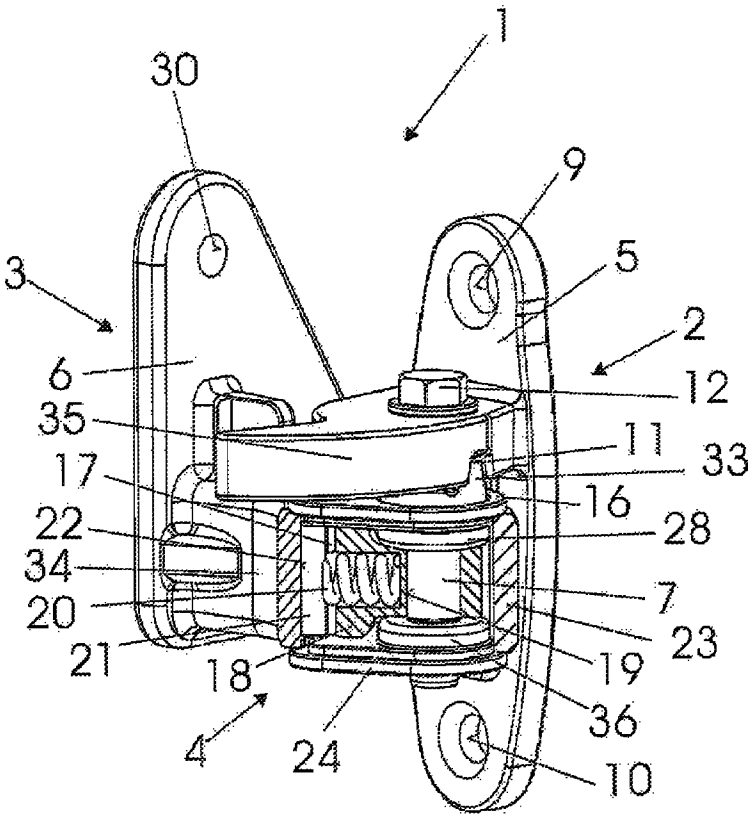
FIG. 3*a* is a perspective view of the arrester of FIG. 1 with a cut-away housing.
Figure 3:
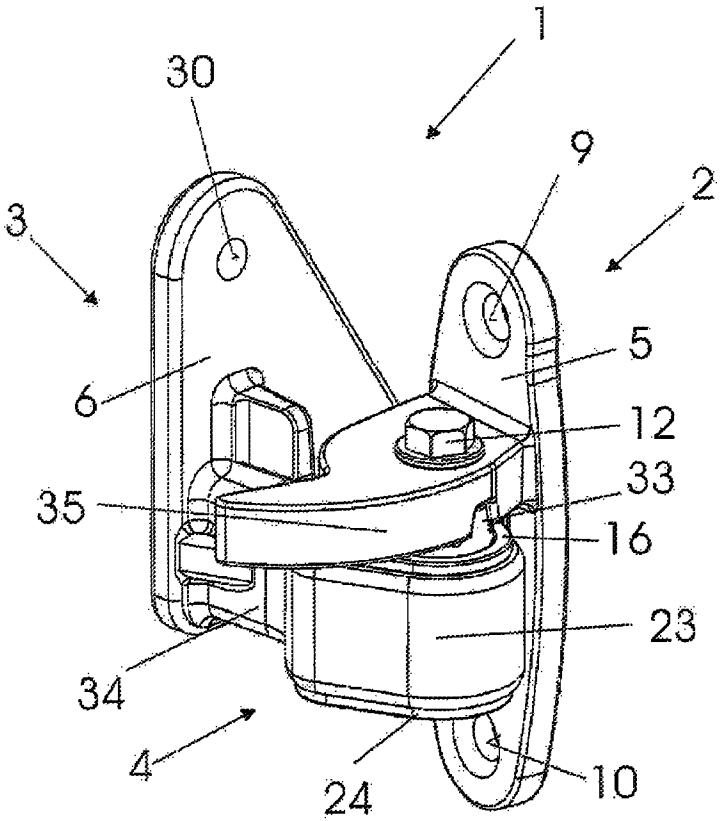
FIG. 3 is a perspective view of the arrester of FIG. 1.
Figure 4A:
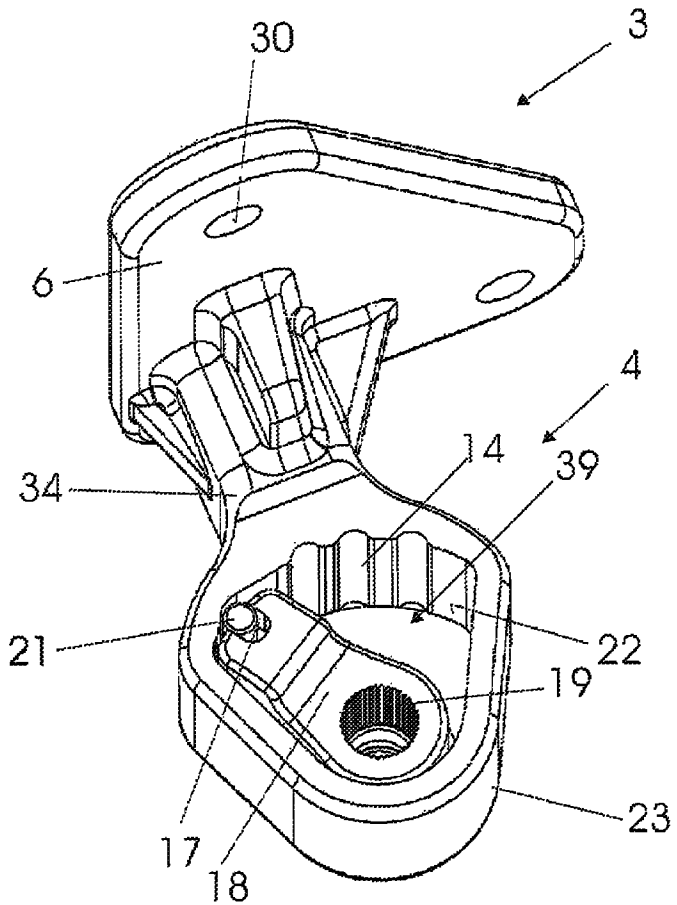
FIG. 4*a* is a perspective view of the pillar fitting of FIG. 4 with the housing cover omitted.
Figure 4:
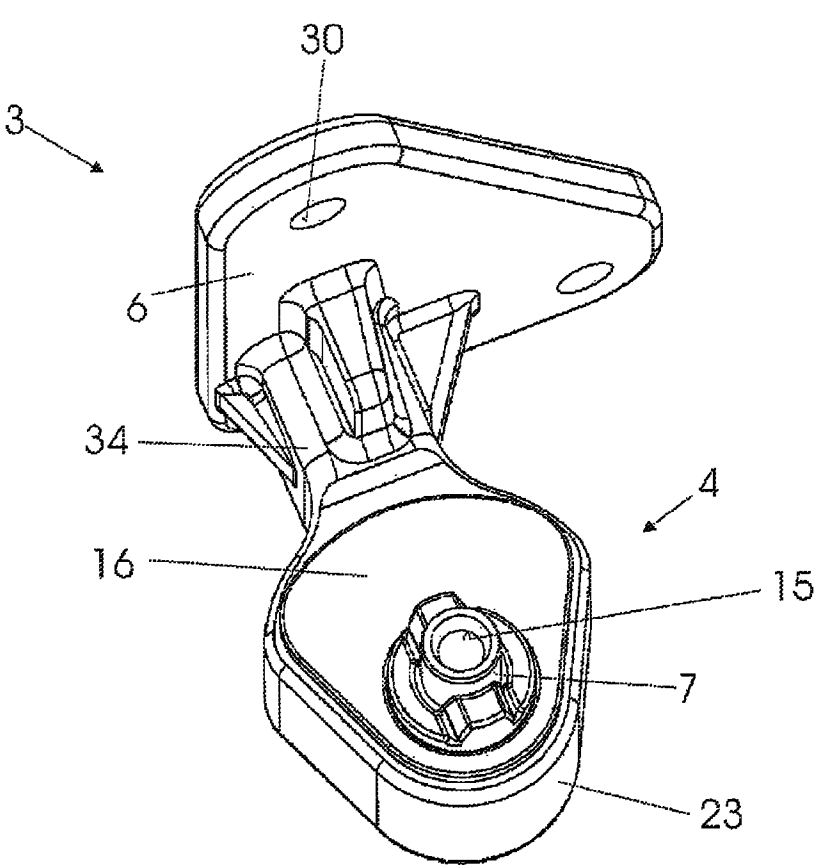
FIG. 4 is a perspective view of a pillar fitting of the motor vehicle door hinge of FIG. 1.

FIG. 1 shows a motor vehicle door hinge 1 with an arrester 4 in an exploded view, in which the individual parts of motor vehicle door hinge 1 are shown in a state separated from each other, wherein their relative arrangement with respect to a main axis is maintained.

Motor vehicle door hinge 1 has a pillar fitting 3 to be mounted on a vehicle body (not shown), and a door fitting 2 connected with pillar fitting 3 in a pivotable manner by means of a hinge pin 7, connectable to a motor vehicle door (also not shown) (cf. FIG. 2 to FIG. 4*a*).

Pillar fitting 3 has a base plate 6 for mounting on the vehicle body. It is provided with through holes 30 for receiving attachment screws by means of which pillar fitting 3 can be screwed to a vehicle body. Adjacent to base plate 6 of pillar fitting 3 is a beam 34 extending toward door fitting 2, on which a housing 23 of an arrester 4 is formed, explained in more detail below.

Beam 34 integrally formed with base plate 6 and thus forming an integral pillar fitting 3, extends essentially vertical to base plate 6.

Housing 23 of arrester 4 is formed on beam 34. Housing 23 has an annular shape surrounding an interior, wherein the cross-section of the interior—as seen in the longitudinal direction of hinge pin 7—remains constant from a top housing opening 38 to a bottom housing opening 39.

A detent element 13 is arranged on an inner side wall 22 of the interior. In the exploded view shown in FIG. 1, detent element 13 is a separate component attached on the inner side wall in an interlocking, metallurgical and/or frictional connection. Detent element 13 can also be formed, however, as shown in the further views of the drawings, in the inner side wall 22 of housing 23. One or more detent notches 14 are then directly made in the inner side wall 22 of housing 23.

A detent body carrier 18 is arranged on hinge pin 7 on a connection section. Hinge pin 7 extends through a receiving opening 19 of the detent body carrier, having a multi-tooth profile, so that detent body carrier 18 is connected with hinge pin 7 in a rotation-resistant manner via a correspondingly formed connection section.

Due to the rotation-resistant connection between detent body carrier 18 and hinge pin 7, a rotary movement of hinge pin 7 is directly transformed into a pivoting movement of detent body carrier 18. A detent body 21 arranged on the end of detent body carrier 18 facing away from hinge pin 7, in the assembled state, is in engagement with detent element 13 and is moved with respect to the latter as hinge pin 7 is rotated, and comes into engagement with detent notches 14 at predetermined angular positions.

Detent body 21 is formed by a cylindrical pin rotatably supported in a correspondingly formed detent body recess 17 open toward detent element 13, on detent body carrier 18. To ensure sufficient detent torques, detent body 21 is biased toward detent element 13 by a helical pressure spring 20 arranged in a recess of detent body carrier 18. The helical pressure spring is in contact with detent body 21 at its one end and with detent body carrier 18 at its other end.

In the assembled state of arrester 4, the interior of housing 23 is dosed off with the detent body carrier 18 arranged within it by a top and bottom housing cover 16, 24, wherein suitable sealing elements (not shown) seal off the interior. To guide hinge pin 7 extending through through-holes 16 of housing covers 16, 24 in the assembled state, they have suitable bearing sections 28, 36. Distance rings 26, 27, 31 and sealing rings 25, 29 secure the position of hinge pin 7 and prevent the introduction of dirt into the interior of arrester 4. Hinge pin 7 is riveted by means of expanding a bore 37 arranged at a lower hinge pin end to achieve axial securing of the position.

To transfer a pivoting movement of the vehicle door to arrester 4, it is necessary to connect hinge pin 7 with door fitting 2 in a rotation-resistant manner. Therefor hinge pin 7 has at its top end a trapezoidal connecting section 33 tapering in the direction toward door fitting 2, arranged in a correspondingly formed receiving opening 11 of door fitting 2 in the assembled state. Receiving opening 11 is arranged at a bottom of a beam 35 of door fitting 2, wherein beam 35 forms door fitting 2 together with a base plate 5 integrally connected with beam 35. Receiving opening 11 is contiguous with a bore 8 extending through beam 35.

In the assembled state of motor vehicle door hinge 1, in which connection section 33 is arranged within receiving opening 11, the top end of hinge pin 7 extends in bore 8. For securing the position of hinge pin 7, a screw 12 is used that can be screwed into a threaded bore 15 at the top end of hinge pin 7 from the side of beam 35 facing the hinge pin 7. Door fitting 2 can be mounted on a vehicle door by means of attachment screws (not shown) extending through openings 9, 10 in base plate 5.

Door fitting 2 and pillar fitting 3 are made of an aluminum alloy for weight reduction.

What is claimed is:

1. A motor vehicle door hinge, comprising:

a pillar fitting able to be mounted on a vehicle body, and a door fitting able to be mounted on a motor vehicle door, which are connected to each other in an articulated manner by hinge pin connected to either the pillar fitting or the door fitting in a rotation-resistant manner and to the remaining one of the pillar fitting or the door fitting in an articulated manner, and an arresting unit comprising a detent body carrier connected to the hinge pin in a rotation-resistant manner and radially extending to the latter and having a detent body, and a detent element adjustable on the other one of the pillar fitting or the door fitting with respect to the detent body carrier, coaxially arranged with respect to the hinge in exit and in engagement with the detent body and including at least one detent notch, and arranged within a housing surrounding the hinge pin and the detent body barrier, wherein the housing it manufactured of extruded profile and has a top and a bottom housing opening in opposing relationship in the hinge axis direction and closed off by correspondingly formed closure elements, wherein both housing openings are formed in such a manner that they allow the hinge pin provided the detent body carrier access to the housing interior, and wherein the housing interior extending from the top to the bottom housing opening has an inner cross-section remaining essentially uniform in the hinge axis direction.

2. The motor vehicle door hinge according to claim 1, wherein the hinge pin is connected with the door fitting in a rotation-resistant manner and the housing is arranged on the pillar fitting.

3. The motor vehicle door hinge according to claim 2, wherein the top and bottom housing openings have an essentially identical opening cross-section.

4. The motor vehicle door hinge, according to claim 3, wherein the closure elements are formed by a top and a bottom housing cover closing off the housing interior in a sealing manner.

5. The motor vehicle door hinge according to claim 4, wherein the pillar fitting is integrally formed.

6. The motor vehicle door hinge according to claim 5, wherein the detent element is arranged on an inner side wall of the housing interior in an interlocking, frictional and/or metallurgical manner.

7. The motor vehicle door hinge according to claim 6, wherein the housing covers include bearing sections for guiding the hinge pin.

8. The motor vehicle door hinge according to claim 7, wherein the detent body carrier has a profile receiving opening for interlocking connection with the hinge pin having a correspondingly formed connection section.

9. The motor vehicle door hinge according to claim 8, wherein the detent body formed by a cylindrical pin rotatably supported on the detent body carrier in a manner biased toward the detent element.

10. The motor vehicle door hinge according to claim 1, wherein the top and bottom housing openings have an essentially identical opening-cross-section.

11. The motor vehicle door hinge according to claim 1, wherein the closure elements are formed by a top and a bottom housing cover closing off the housing interior in a sealing manner.

12. The motor vehicle door hinge according to any claim 1, wherein the pillar fitting is integrally formed.

13. The motor vehicle door hinge according to claim 1, wherein the detent element is arranged on an inner side wall of the housing interior in an interlocking, frictional and/or metallurgical manner.

14. The motor vehicle door hinge according to claim 1, wherein the housing covers include bearing sections for guiding the hinge pin.

15. The motor vehicle door hinge according to claim 1, wherein the detent body carrier has a profiled receiving opening for interlocking connection with the hinge pin having a correspondingly formed connection section.

16. The motor vehicle door hinge according to claim 1, wherein the detent body is formed by a cylindrical pin rotatably supported on the detent body carrier in a manner biased toward the detent element.

17. A motor vehicle door hinge, comprising:

a pillar fitting with a base plate able to be mounted on a vehicle body, and a door fitting able to be mounted on a motor vehicle door, which are connected to each other in an articulated manner by means of a hinge pin connected to either the pillar fitting or the door fitting in an articulated manner, and an arresting unit comprising a detent body carrier connected to the hinge pin in a rotation-resistant manner and radially extending to the latter and having a detent body, and a detent element adjustable on the other one of the pillar fitting or the door fitting with respect to the detent body carrier, coaxially arranged with respect to the hinge pin axis and in engagement with the with the detent body and including at least one detent notch, and arranged within a housing surrounding the hinge pin and the detent body carrier, wherein the base plate and the housing are formed in one component forming an integral pillar fitting, and wherein the housing is manufactured of one extruded profile and has a top and a bottom housing opening in opposing relationship in the hinge axis direction and closed off by correspondingly formed closure elements, wherein both housing openings are formed ins such a manner that they allow the hinge pin provided with the detent body carrier access to the housing interior, and wherein the housing interior extending from the top to the bottom housing opening has an inner cross-section reaming essentially uniform in the hinge axis direction.

* * * * *